United States Patent [19]

Tindall et al.

[11] Patent Number: 4,782,330

[45] Date of Patent: Nov. 1, 1988

[54] DATA ACQUISITION SYSTEM

[75] Inventors: David W. Tindall, Caversham, England; Ronald E. R. Patey, Georgetown, Canada

[73] Assignee: Chubb Electronics Limited, Feltham, England

[21] Appl. No.: 66,910

[22] Filed: Jun. 25, 1987

[30] Foreign Application Priority Data

Jul. 3, 1986 [GB] United Kingdom ..... 8616276

[51] Int. Cl.[4] ..... G08B 26/00

[52] U.S. Cl. ..... 340/541; 341/518; 341/870.09; 341/870.16; 341/870.19; 375/22

[58] Field of Search ..... 340/541, 518, 505, 870.09, 340/870.16, 870.19; 375/22, 37, 107

[56] References Cited

U.S. PATENT DOCUMENTS

| | | | |
|---|---|---|---|
| 4,088,985 | 5/1978 | Saito et al. | 340/413 |
| 4,294,065 | 10/1981 | Lane | 340/518 |
| 4,538,138 | 8/1985 | Harvey et al. | 340/518 |
| 4,573,041 | 2/1986 | Kitagawa et al. | 340/505 |
| 4,668,939 | 5/1987 | Kimura et al. | 340/505 |

FOREIGN PATENT DOCUMENTS

| | | |
|---|---|---|
| 1157924 | 11/1983 | Canada. . |
| 1101122 | 1/1968 | European Pat. Off. . |
| 1494240 | 12/1977 | European Pat. Off . |
| 0134174 | 3/1985 | European Pat. Off. . |
| 2121222 | 12/1983 | United Kingdom . |
| 2121223 | 12/1983 | United Kingdom . |
| 2156126 | 10/1985 | United Kingdom . |

*Primary Examiner*—Glen R. Swann, III.
*Attorney, Agent, or Firm*—Jerry A. Miller

[57] ABSTRACT

A data acquisition system, e.g. for an intrusion alarm system, has a plurality of distributed sensors connected in sets to nodal units or concentrators. The concentrators are interrogated by clock pulses broadcast from a central control unit and when each concentrator's address is reached it transmits back to the central unit a set of pulse signals the widths of which represent the voltage levels of the respective sensors connected to it. Analogue sensor outputs may thus be transmitted. The sensor outputs are also preferably integrated at the concentrators, prior to pulse-conversion, over a period corresponding to a complete cycle of the local mains supply, thus to eliminate any mains interference.

11 Claims, 3 Drawing Sheets

DATA ACQUISITION SYSTEM

FIELD OF THE INVENTION

The present invention relates to data acquisition systems.

In particular, the invention is concerned with a system of data acquisition for use in integrated intruder alarm systems and it is in terms of its application to such service that the invention is more particularly described hereinafter. In principle, however, systems in accordance with the invention may also find utility in many other applications which involve the monitoring of a plurality of distributed sensor outputs, such as in fire detection, property supervision, industrial process control or even medical monitoring.

BACKGROUND

One aim of the invention is to provide for an improved intruder alarm system in which the status of each one of a relatively large number of sensors, distributed for example throughout a building, is individually identifiable. Such "individual detector identification" (IDI) systems are already known. In a conventional IDI system the various sensors are connected to a central control unit in a loop and each one returns a signal indicative of its state when addressed in turn by a signal passed from the preceding sensor in the loop. Since each sensor has to have its own processing and signalling electronics this arrangement is relatively expensive, and can also cause problems with the amount of trunked wiring and multiplicity of connections involved. A more particular aim of the present invention is therefore to achieve an IDI capability more cost-effectively than with the conventional looped system.

Another aim of the invention is to provide a system capable of handling sensor outputs in analogue voltaic form. Analogue sensors clearly have the advantage over binary output sensors of being able to return data concerning a range of sensed conditions. More than this, however, a system which is capable of discriminating a range of different output voltage levels from a given sensor—as opposed to simply the presence or absence of a voltage, or a voltage above or below a predetermined threshold—can be used to advantage for diagnostic purposes, e.g. for detecting and compensating for drifts in output voltage due to ageing or contamination of sensor components, or for identifying other faults or failures which result in off-normal outputs. The advantages of fault-diagnosis apply equally well to binary sensors having an identifiable "normal" output voltage as they do to true analogue sensors. It is not, therefore, an essential feature of a system according to the invention that it actually employs analogue sensors, only that it is capable of so doing by virtue of its ability to transmit signals representing a range of sensor output voltages.

The present invention accordingly resides in a data acquisition system comprising: a plurality of distributed sensors each one of which is adapted to provide a voltage output indicative of a value or condition sensed thereby; a plurality of nodal units to which the outputs of respective sets of said sensors are connected; and a central unit adapted to receive data from said sets of sensors in response to its repetitive interrogation, in turn, of the respective said nodal units to which the sets of sensors are connected; each said nodal unit being adapted repetitively to derive in respect of each said sensor in the set connected thereto a pulse signal the width of which represents the voltage level of the respective sensor output, and to transmit the corresponding set of pulse signals in turn to the central unit when interrogated thereby.

In a system according to the invention, therefore, the output of each individual sensor is identifiable from its order position in the set of pulse signals transmitted by the respectively interrogated nodal unit, while the necessary processing and signalling capability is effectively shared between the members of each set of sensors at the respective such unit. By the use of suitable multiplexing circuits in the nodal units (also referred to hereinafter as "concentrators") the overall processing time required to complete a scan of the status of a given number of sensors can be considerably reduced in comparison with a conventional looped IDI system as described above. The arrangement of nodal units can also simplify the wiring and connections required. The pulse-width modulation regime incorporated at the nodal units means that analogue data can be reliably transmitted to, and decoded at, the central unit.

In a preferred embodiment it is arranged that the output voltage of each sensor, at each scan, is integrated at the respective nodal unit over a period corresponding to one cycle of the local mains supply, thus to eliminate the effects of any mains hum on the sensor outputs. Other preferred nodal unit features include the ability to switch power to its connected sensors only during those periods when their outputs are being scanned, and to phase its transmission of the pulse-width modulated signals in relation to its scanning of the sensor outputs and the transmission of the other nodal units to achieve a minimum cycling time.

These and other features of the present invention will now become more apparent from the following description, given by way of example, of one preferred embodiment of a system in accordance therewith, taken in conjunction with the accompanying schematic drawings in which:

DETAILED DESCRIPTION OF THE INVENTION

Figure 1:
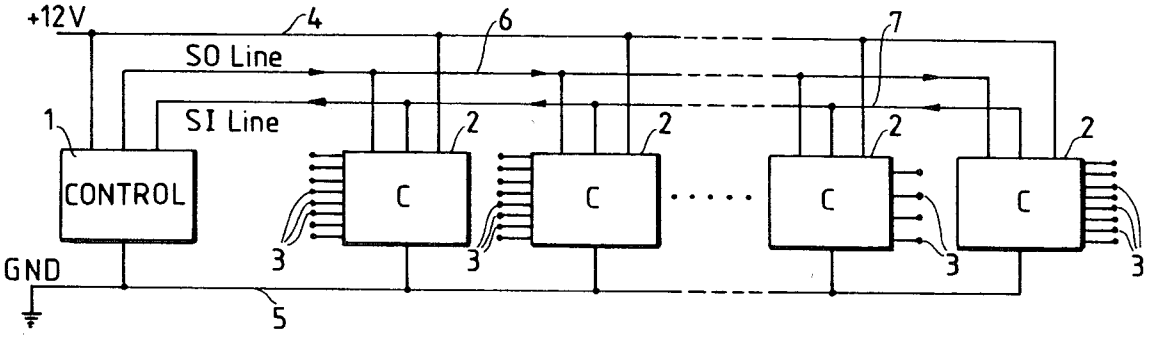
FIG. 1 illustrates the connection of nodal units to a central controller in, an intruder alarm system incorporating the present invention.

Referring to FIG. 1, the illustrated alarm system comprises a central controller 1 and several remote nodal units or concentrators 2 to each one of which is connected a set of alarm sensors 3. For the purposes of the following description it is assumed that the individual concentrators serve either eight or four sensors each, up to a total of 64 sensors in the system. While this arrangement of eight and four-way concentrators has been found convenient for signal transmission purposes and gives some flexibility to the task of installation while enabling significant standardisation of manufacture, there is in principle no reason why other numbers of sensor connections to respective concentrators could not be used. The concentrators are connected to the controller via 4-core cable in a multi-drop (bus) format.

Two wires 4 and 5 are for power supplies (12 V and ground) to the concentrators, one is for a signal output (S0) line 6 from the controller to the concentrators (with respect to ground) and the other is for a signal input (SI) line 7 from the concentrators to the controller (with respect to ground).

The principle of operation of this system is that, for each scan, the controller 1 interrogates the concentrators 2 in turn by broadcasting a stream of clock pulses on the S0 line 6 followed by a period of silence. Each concentrator contains a clock counter which is reset by the absence of clock during the silent period between scans. Once the clock stream commences, each concentrator counts rising edges of the pulses and becomes "active" in its turn at a particular count which has been assigned to it as its individual address. During its period of activity, the concentrator scans the voltage outputs of the set of sensors 3 connected to it and returns on the SI line 7 a series of pulse-width modulated signals representing those voltages together with a signal indicating its own "tamper" status, all in a manner to be more fully described below.

For the correct operation of this scheme the single-spur interconnect configuration shown in FIG. 1 is sufficient. However, the 4-wire cable 4–7 may instead be used in a loop returning the controller 1, which will reduce the voltage drop down the cable and enable an improvement in system robustness. For example, if the loop is returned to the same port on the controller then correct operation will be maintained if a single break occurs anywhere in the loop; in the event of multiple breaks the controller will still be able to detect which concentrators are responding and which have been lost. By returning the loop to a second port (i.e. the controller is able to transmit and receive on both ports independently), the location of a single break can be determined. It is envisaged that the length of the trunk in this system may be up to 2 km.

It has been stated that, at the appropriate time during each full scan, each concentrator 2 returns signals on the SI line 7 representing the outputs of its set of sensors 3 plus its own "tamper" status (the latter of which indicates any attempt to remove the lid of the concentrator housing). For a reason to be explained later, each 8-way concentrator in fact returns its tamper status twice per scan, so that the total number of signal pulses to be returned by an 8-way concentrator per scan is ten. The timing of the signals put on to the SI line by the concentrators is derived from the SO line 6, so that an 8-way concentrator takes a ten clock pulse period to return its data. Furthermore, it is a feature of this particular system that the voltage outputs of the sensors 3 are each integrated at the respective concentrators over a period corresponding to a complete cycle of the local mains supply, to eliminate mains interference, and it is convenient to set this period also to correspond to ten clock periods. This integration process must therefore be started at a respective concentrator ten clock periods before its data transmission commences so that an 8-way concentrator must be "active" for a total of twenty clock periods. The operation can be arranged to overlap the active periods of successive concentrators by 10 clock pulses so that while one concentrator is returning its data the next is integrating—so that the total number of clock pulses required per scan on a system containing eight 8-way concentrators (64 sensors) is $(8\times 10)$ plus 10 for the first concentrator to integrate its first sensor output at the beginning of the scan and one more for the last period of transmission from the last concentrator to be validated, i.e. 91 pulses in total. The same is true if instead some or all of the 8-way concentrators are replaced by 4-way concentrators. By appropriate setting of the addresses of each concentrator 4- and 8-way concentrators can be intermixed, a 4-way concentrator being arranged to respond in the same way as an 8-way concentrator except that it will return only four sensor data pulses plus its own tamper status pulse. The combined response of two 4-way concentratos offset in address by 5 clock pulses corresponds to the response which would be evoked by a single 8-way concentrator set to the same address as the first of the 4-ways, which is why an 8-way concentrator is arranged to send two tamper signals (one displaced from the other by 5 clock pulses).

The fact that integrations are performed over a ten clock pulse period corresponding to the cycle period of the local mains supply sets the fundamental clock period at 2 ms and 1.67 ms for 50 Hz and 60 Hz mains frequencies respectively. A silence period of 18 ms at the end of each scan is sufficient to be detected by the concentrators as a reset. Therefore, for a fully loaded system of 64 sensors the total scanning period with a 50 Hz supply will be $(91\times 2)$ plus 18 ms, i.e. 200 ms, giving a scan rate of 5 per second, and slightly faster with a 60 Hz supply.

Figure 2:
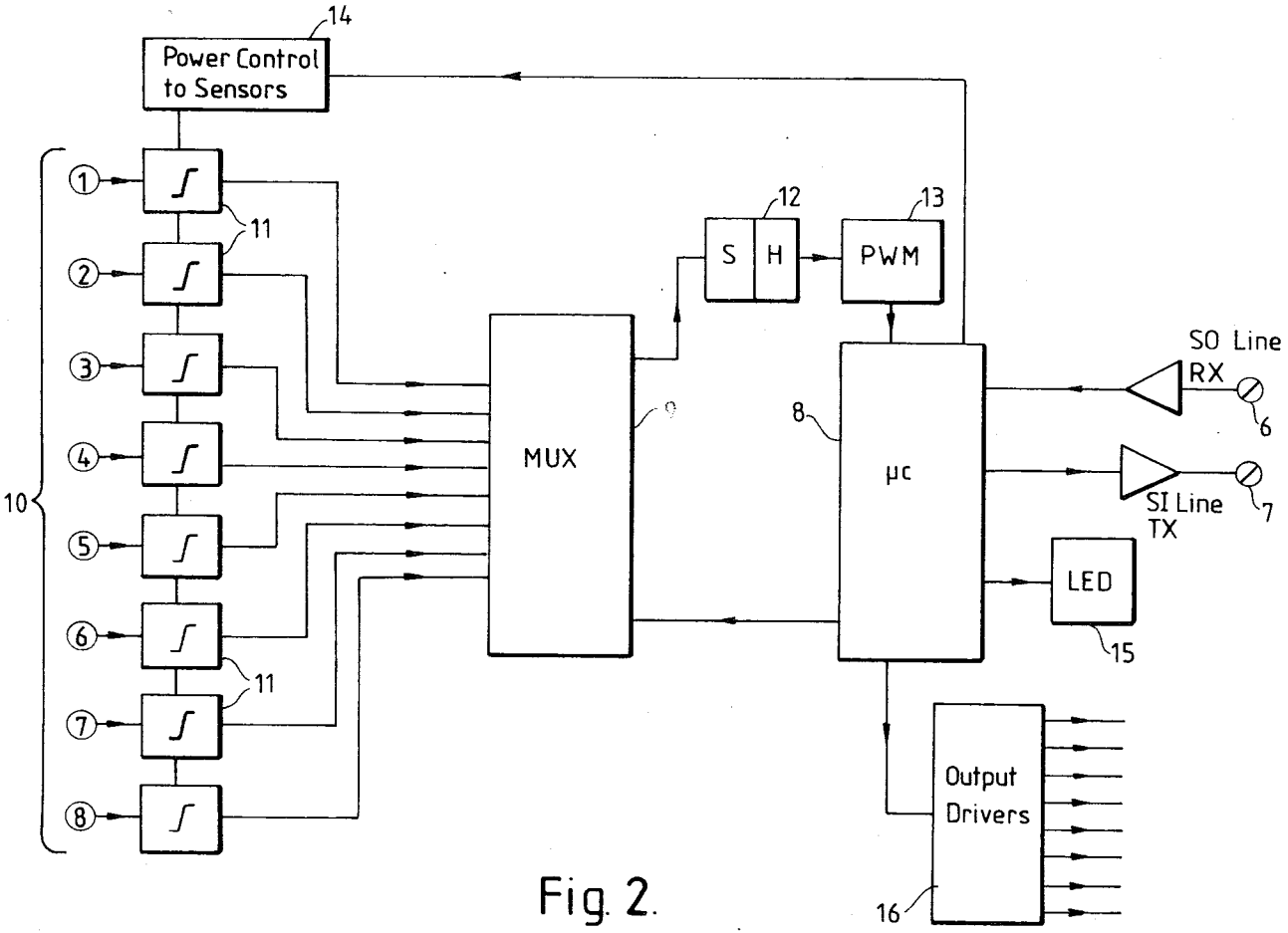
FIG. 2 is a simplified block diagram of one of the nodal units.

Turning to FIG. 2, this indicates the general arrangement of an 8-way concentrator, the major components being a microcontroller 8, multiplexer 9, sensor inputs 10 with respective integrators 11, sample and hold capacitor 12, pulse width modulator 13, and sensor power controller 14. 4-way concentrators are the same, except that sensors will be connected only to inputs corresponding to nos. 1–4 of an 8-way concentrator.

The activity of an 8-way concentrator during one scanning period is described as follows, in connection with which reference to FIG. 3 will also be useful. The microcontroller 8 monitors SO line 6 and is reset to the start of its programmed by the silence period between scans. It reads the concentrator address and data identifying it as an 8 or 4-way device from hard-wired option links within the concentrator, detects the tamper status (a binary value) e.g. from an associated microswitch or other tamper sensor, and applies address 0 to the multiplexer 9. The positive edge of each successive clock pulse is detected and the clock count incremented until the individual concentrator address is reached. At this point power is switched by unit 14 to the sensor networks; each sensor input 10 generates a respective analogue voltage from the associated sensor output by means of a resistor network, and inputs to a respective RC integrator 11. The multiplexer 9 is also enabled, and thus discharges the integrator at the first sensor input. At the beginning of the next clock period the multiplexer address is incremented so that the first sensor input begins a fresh period of integration and the integrator at the second sensor input is discharged. The multiplexer address is incremented again for the next two clock periods, so that by the end of the active period 4 of the concentrator the first four sensor inputs will have been discharged and be at various stages of signal integration.

During active period 5 the multiplexer address is incremented again and the integrator at the fifth sensor input is discharged. The multiplexer address is not then incremented until active period 7, however, so that integration of input 5 is delayed behind input 4 by an extra clock period (to allow insertion of tamper information during the subsequent output phase). The process is then continued until by active period 10 all of the sensor inputs have been discharged and are integrating, and the multiplexer is inhibited. During the eleventh active period the ten-period integration of sensor input 1 is completed, and the tamper status pulse is also modulated onto the SI line.

Active period 12 is the start of transmission of sensor data. At the beginning of this period the multiplexer is inhibited and address O selected, the pulse width modulation capacitor is discharged, and the SI driver to the positive rail is turned on. The multiplexer is then enabled for a period of approximately 10 μs during which it takes a sample from the integration on sensor input 1 and passes it to the sample and hold capacitor 12 on the input to the pulse width modulator 13. The microcontroller now monitors the output of the pulse width modulator and when that output toggles, indicating that a pulse width corresponding to the sensor input voltage has been produced, the driver to the SI line is driven low. A minimum pulse width of 10% of the clock period is always sent as proof of correct operation. In the event that the modulator output has not toggled by 90% of the clock period the microcontroller truncates the signal on the SI line, indicating a maximum width pulse.

At the end of the period, the multiplexer address is incremented ready for sensor input 2, and the same process as described above is performed during active periods 13, 14, 15, 17, 18, 19 and 20 for the transmission of pulse widths corresponding to the voltages at sensor inputs 2–8 respectively, the tamper information being transmitted again during period 16. At the end of the 20th period, power to the sensor networks is switched off and the concentrator remains inactive until the next scan, except to monitor the SO line. The ability to switch power to the connected sensors only during the active period of the respective concentrator is of advantage in minimising both the overall power-consumption of the system and the power rating of the trunk.

A 4-way concentrator would emulate the above operation in respect of the integration and data transmission of the first four sensor outputs and the first tamper signal.

Figure 3:
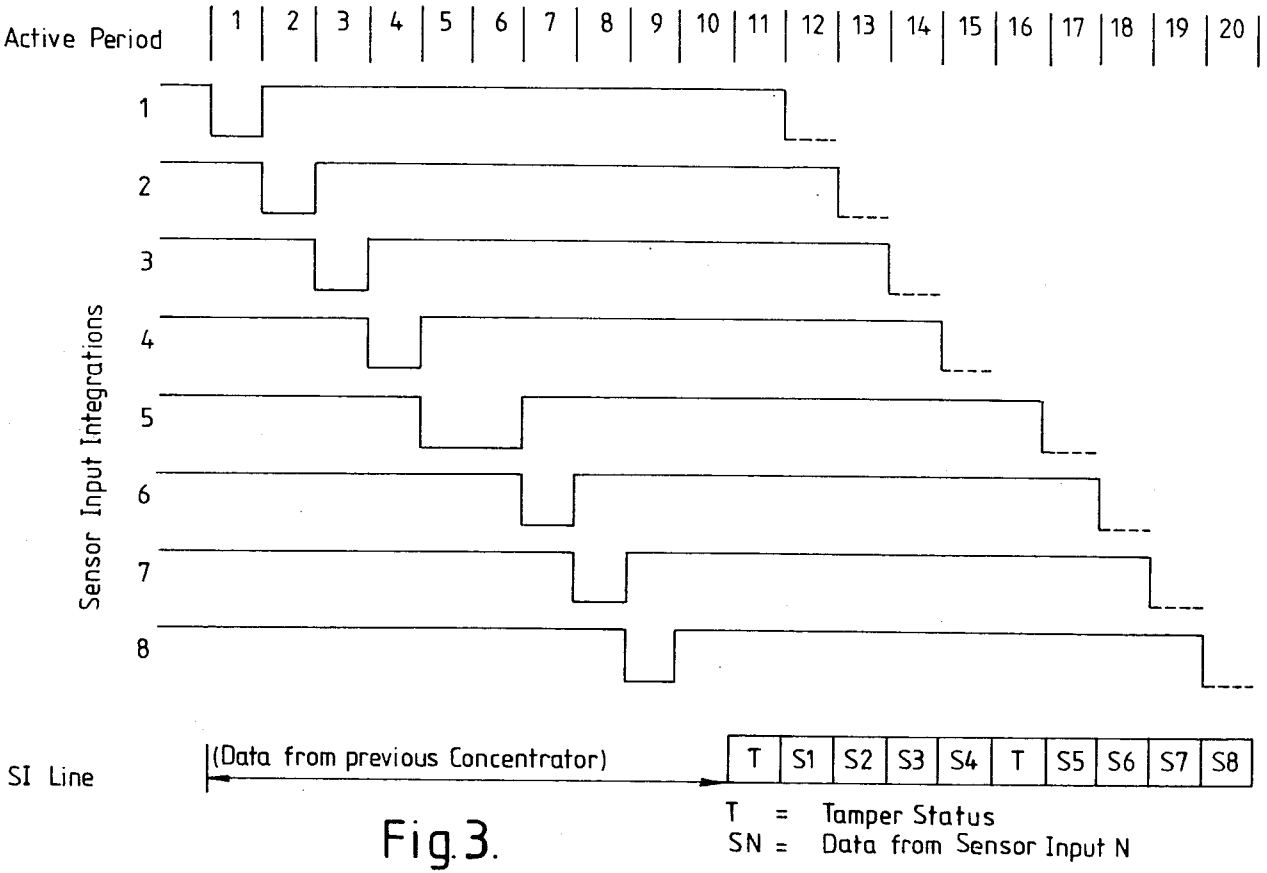
FIG. 3 is a diagram illustrating the phasing of the activity for a given nodal unit.

There results on the SI line of a fully-loaded (64 sensor) system a 90-period cycle of data transmission in which the first 10 periods are silent (while the first sensor input of the first concentrator is integrating) and the next 80 periods comprise the 64 pulse-width modulated signals representing the 64 sensor voltages and 16 tamper status signals, in the order determined by the order of interrogation of the concentrators and the order of data transmission within each concentrator as indicated in FIG. 3. Each sensor value and concentrator tamper status is therefore individually identifiable at the controller 1 from its respective position in the data stream. At the controller, the pulse width information from the concentrators is demodulated to produce a corresponding digital response for each sensor on the system. Accurate measurement of each pulse width is necessary if the analogue data is to be sufficiently resolved. One method is to use a high speed clock (e.g. 100 KHz) and an associated counter which counts whenever the input signal is high during the period of a received pulse, thus being less susceptible to line noise than, for example, an edge-triggered arrangement.

While the primary purpose of the clock pulses broadcast by the controller 1 on the SO line is for interrogation of the concentrators 2 and for synchronisation of the data returned thereby, it is also possible, if desired, to modulate the width of the clock pulses for the transmission of data to the concentrators. Data for a respective concentrator could be modulated onto those pulses on the SO line which are read by the concentrator during the first half of its active period following recognition of its address, and could be used by the microcontroller at the concentrator for controlling external outputs e.g. for lighting indicator lamps at the concentrator in the event of an alarm or fault indication being received from any of its sensors, and/or for completely unconnected purposes such as the control of building lights or other services. In FIG. 2 this function is illustrated schematically by the LED control 15 and the several external output drivers 16.

Additional protection can be built into the system to prevent substitution of concentrators by potential intruders. As it stands, it might be possible to connect into the system a substitute concentrator arranged to give normal readings for all sensor inputs, and to switch over to this substitute in place of a genuine concentrator during the silent period. Then the genuine concentrator would not be observed by the controller and off-normal sensor inputs connected to it would not be detected. In order to defeat an attack of this kind it is proposed to width-modulate the tamper signals from each concentrator for successive scans in accordance with a predefined repeating sequence, the starting point within which, when the system is activated, is based on unique information within the respective concentrator, (e.g. its address). During normal operation, the sequence of modulated tamper signals from each concentrator will be in synchronism with the sequence "expected" of it at the controller. Accordingly, any attempt to substitute a new concentrator while the system is running, without complete knowledge of the modulation sequence and the point within it which the respective genuine concentrator has reached at the time of switch-over, will cause this synchronism to be lost and a tamper alarm to be raised.

In a further modification of the described alarm system, each concentrator is arranged to be active throughout each system scan and to scan its own sensor inputs as described above repetitively during this period (still using the SO clock as timing reference), i.e. not just once per system scan as previously described; in this case, of course, the unit 14 will also provide power to the sensors throughout each system scan. If during any one of these multiple scans an off-normal state occurs on any input then that state will be latched within the concentrator and transmitted accordingly when it is that concentrator's turn to put its data onto the SI line. An advantage of this is that it becomes possible to detect off-normal sensor inputs of very short duration—in the limit each sensor input can be scanned every 20 ms/16.7 ms in the 50 Hz and 60 Hz systems described. Additionally, multiple scanning within the concentrators enables the address field to be increased and many more concentrators and sensors to be added to the system—although the rate at which the individual concentrators can be scanned by the controller decreases as the size of the system increases, multiple scanning of the sensor inputs within the concentrators means that detection of short off-normal states at the concentrators is still retained and a possible delay of even a few seconds in the transmission of those states from the concentrators to the controller is not generally considered critical.

We claim:

1. A data acquisition system comprising: a plurality of distributed sensors, each one of which is adapted to provide a voltage output indicative of a value or condition sensed thereby; a plurality of nodal units to which the outputs of respective sets of said sensors are connected; and a central unit adapted to receive data from said sets of sensors in response to its repetitive interrogation, in turn, of the respective said nodal units to which the sets of sensors are connected; each said nodal unit being adapted to derive, in respect of each said sensor in the set connected thereto, a pulse signal the width of which represents the voltage level of the respective sensor output and to transmit the corresponding set of pulse signals, in turn, to the central unit when interrogated thereby.

2. A system according to claim 1 comprising means within each nodal unit for integrating the voltage output of each sensor connected thereto over a period corresponding to a cycle of a local mains electrical supply and means for producing said pulse signals from the results of said integrations.

3. A system according to claim 2 wherein the activity of said nodal units is phased such that each respective succeedingly-interrogated nodal unit commences an operation to integrate the outputs of the sensors connected thereto during the period when the respective precedingly-interrogated nodal unit is transmitting its respective set of pulse signals to the central unit, whereby each respective succeedingly-interrogated nodal unit is able to transmit its respective set of pulse signals to the central unit substantially without delay after said transmission by the respective precedingly-interrogated nodal unit.

4. A system according to claim 1 comprising means within each nodal unit for interrupting the supply of electrical power to the sensors connected thereto during periods when the respective nodal unit is not operating to derive said pulse signals.

5. A system according to claim 1 wherein each nodal unit is adapted to scan the outputs of the sensors connected thereto repetitively during the course of each cycle of interrogation of the nodal units by the central unit, and to retain for transmission to the central unit as a said pulse signal when the respective nodal unit is interrogated thereby any output from a respective said sensor existing at the time of any said scan thereof which is indicative of an abnormal value or condition.

6. A system according to claim 1 wherein the central unit is adapted repetitively to broadcast to all of the nodal units a predetermined stream of clock pulses; each nodal unit includes means for counting said clock pulses; and each nodal unit has assigned to it an interrogation address corresponding to a respective specified number of said clock pulses.

7. A system according to caim 6 wherein each nodal unit includes means for synchronising with said clock pulses its transmission of said pulse signals to the central unit.

8. A system according to claim 6 wherein the central unit includes means for width-modulating said clock pulses whereby to transmit data to the nodal units; and each nodal unit includes output means adapted to be controlled by data transmitted thereto by such modulated clock pulses.

9. A system according to claim 1 wherein each nodal unit is adapted to transmit to the central unit together with each aforesaid set of pulse signals an additional pulse signal indicative of a condition of the nodal unit itself.

10. A system according to claim 9 wherein each nodal unit includes means for width-modulating in accordance with a predetermined seguence successive said additional pulse signals transmitted by the respective nodal unit; and the central unit is adapted to monitor said sequences of modulation as transmitted by the respective nodal units whereby to verify the genuineness of the data received therefrom.

11. A system according to any preceding claim wherein said sensors comprise intrusion alarm sensors and the central unit is adapted to provide an alarm output in the event of the transmission by a nodal unit of a pulse signal derived from a sensor output indicative of intrusion.

* * * * *